US005983525A

United States Patent [19]

Brown

[11] Patent Number: 5,983,525

[45] Date of Patent: Nov. 16, 1999

[54] VENTED SHOE SOLE

[76] Inventor: Leon T. Brown, 515 $1_{st}$ #125, Galveston, Tex. 77550

[21] Appl. No.: 09/061,202

[22] Filed: Apr. 16, 1998

[51] Int. Cl.[6] ..... A43B 7/06

[52] U.S. Cl. ..... 36/3 B

[58] Field of Search ..... 36/3 B, 3 A, 3 R

[56] References Cited

U.S. PATENT DOCUMENTS

| | | |
|---|---|---|
| 622,673 | 4/1899 | Ferrata . |
| 2,884,716 | 5/1959 | Shelare et al. . |
| 4,525,940 | 7/1985 | Mochizuki . |
| 5,505,010 | 4/1996 | Fukuoka . |
| 5,813,140 | 9/1998 | Obeid . |

FOREIGN PATENT DOCUMENTS

| | | |
|---|---|---|
| 183678 | 3/1955 | Austria . |
| 2670369 | 6/1992 | France . |
| 118546 | 6/1900 | Germany . |
| 2240542 | 7/1991 | United Kingdom . |
| 93007774 | 4/1993 | WIPO . |

*Primary Examiner*—Ted Kavanaugh

[57] ABSTRACT

An air cushioned shoe is provided including a sole with an upper coupled thereto for containing a foot of a user. Also included is an air flow chamber situated within a heel portion of the sole. The air flow chamber further includes an aperture formed in a top face thereof which remains in communication with the shoe. The air flow chamber further has a plurality of bellows situated between a rear of the air flow chamber and a rear of the sole for directing a flow of air through the aperture of the air flow chamber when the user walks.

8 Claims, 2 Drawing Sheets

FIG. 3
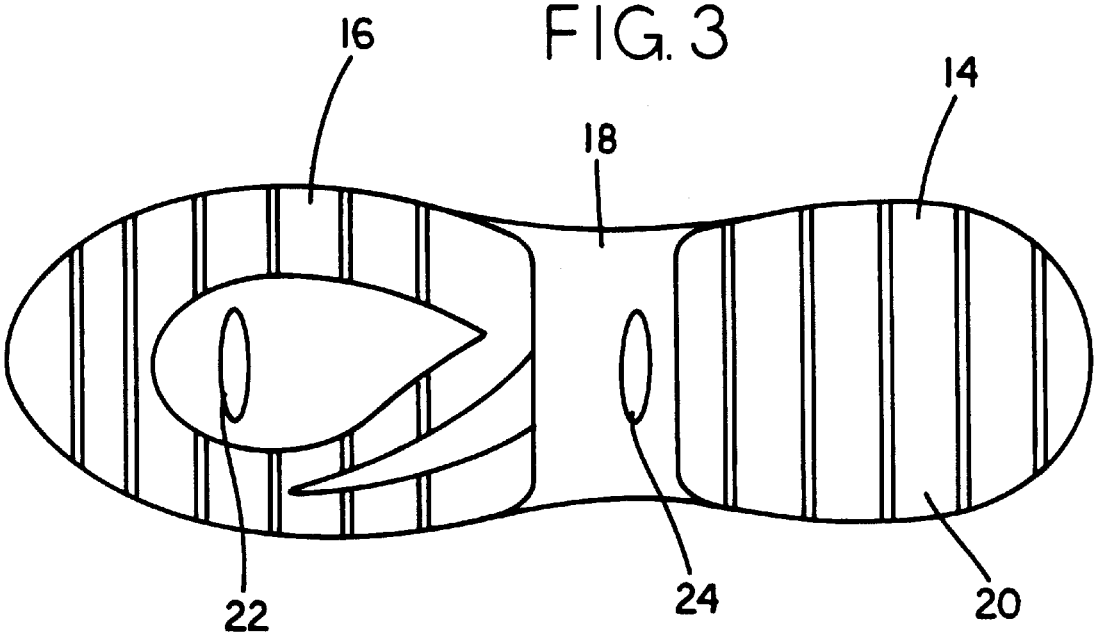
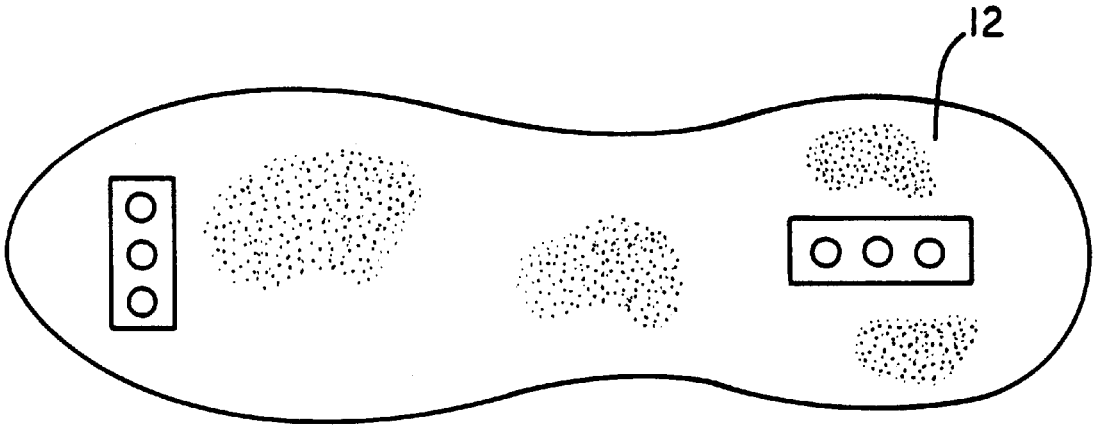
FIG. 4

VENTED SHOE SOLE

BACKGROUND OF THE INVENTION

1. Field of the Invention

The present invention relates to air filled shoe soles and more particularly pertains to a new vented shoe sole for providing a foot of a user with ventilation.

2. Description of the Prior Art

The use of air filled shoe soles is known in the prior art. More specifically, air filled shoe soles heretofore devised and utilized are known to consist basically of familiar, expected and obvious structural configurations, notwithstanding the myriad of designs encompassed by the crowded prior art which have been developed for the fulfillment of countless objectives and requirements.

Known prior art air filled shoe soles include U.S. Pat. No. 5,400,526; U.S. Pat. No. 5,408,760; U.S. Pat. No. 5,282,324; U.S. Pat. No. 5,295,313; U.S. Pat. No. 5,299,368; and U.S. Pat. Des. 268,710.

In these respects, the vented shoe sole according to the present invention substantially departs from the conventional concepts and designs of the prior art, and in so doing provides an apparatus primarily developed for the purpose of providing a foot of a user with ventilation.

SUMMARY OF THE INVENTION

In view of the foregoing disadvantages inherent in the known types of air filled shoe soles now present in the prior art, the present invention provides a new vented shoe sole construction wherein the same can be utilized for providing a foot of a user with ventilation.

The general purpose of the present invention, which will be described subsequently in greater detail, is to provide a new vented shoe sole apparatus and method which has many of the advantages of the air filled shoe soles mentioned heretofore and many novel features that result in a new vented shoe sole which is not anticipated, rendered obvious, suggested, or even implied by any of the prior art air filled shoe soles, either alone or in any combination thereof.

To attain this, the present invention generally comprises a sole formed of an elastomeric material. The sole has a heel portion with a first thickness and a toe portion with a second thickness less than ⅓ the first thickness. Formed between the toe and heel portion is an intermediate portion which is defined by a tapering top face. As shown in FIG. 2, a bottom surface of each portion of the sole remains within a common plane and has a gripping material mounted thereon. To define a shoe, the sole has a low top leather upper coupled thereto for containing a foot of a user. Next provided is a pair of vents including a toe vent having an oval cross-section along a length thereof. The toe vent includes a bottom end laterally disposed at a central extent of the bottom surface of the toe portion of the sole. A top end of the toe vent terminates in three laterally aligned apertures formed in an upper surface of the toe portion of the sole. The toe vent further has an intermediate extent extending upwardly and forwardly from the bottom surface of the toe portion of the sole, as shown in FIG. 2. The pair of vents further include a heel vent having an oval cross-section along a length thereof. The heel vent includes a bottom end laterally disposed at a central extent of the bottom surface of the intermediate portion of the sole. See FIG. 3. A top end of the heel vent terminates in three longitudinally aligned apertures formed in an upper surface of the heel portion of the sole. As shown in FIG. 2, an intermediate extent extends upwardly and rearwardly from the bottom surface of the intermediate portion of the sole. Finally, an air flow chamber is provided having an oval cross-section formed along a length thereof. The air flow chamber is situated about a horizontal axis which is laterally disposed within the heel portion of the sole. The air flow chamber has a pair of ends with transparent membranes mounted thereon which are visible from sides of the sole. The air flow chamber further includes an aperture formed in a top face thereof which remains in communication with the top end of the heel vent. As shown in FIGS. 1 & 2, the air flow chamber further includes a plurality of bellows situated between a rear of the air flow chamber and a rear of the sole. Such bellows function for directing a flow of air through the aperture of the air flow chamber when the user walks.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vented shoe sole apparatus and method which has many of the advantages of the air filled shoe soles mentioned heretofore and many novel features that result in a new vented shoe sole which is not anticipated, rendered obvious, suggested, or even implied by any of the prior art air filled shoe soles, either alone or in any combination thereof.

It is another object of the present invention to provide a new vented shoe sole which may be easily and efficiently manufactured and marketed.

It is a further object of the present invention to provide a new vented shoe sole which is of a durable and reliable construction.

An even further object of the present invention is to provide a new vented shoe sole which is susceptible of a low cost of manufacture with regard to both materials and labor, and which accordingly is then susceptible of low prices of sale to the consuming public, thereby making such vented shoe sole economically available to the buying public.

Still yet another object of the present invention is to provide a new vented shoe sole which provides in the apparatuses and methods of the prior art some of the advantages thereof, while simultaneously overcoming some of the disadvantages normally associated therewith.

Still another object of the present invention is to provide a new vented shoe sole for providing a foot of a user with ventilation.

Even still another object of the present invention is to provide a new vented shoe sole with an upper coupled thereto for containing a foot of a user. Also included is an air flow chamber situated within a heel portion of the sole. The air flow chamber further includes an aperture formed in a top face thereof which remains in communication with the shoe. The air flow chamber further has a plurality of bellows situated between a rear of the air flow chamber and a rear of the sole for directing a flow of air through the aperture of the air flow chamber when the user walks.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the sole of the present invention.

FIG. 4 is a top view of the sole of the present invention.

DESCRIPTION OF THE PREFERRED EMBODIMENT

Figure 1:
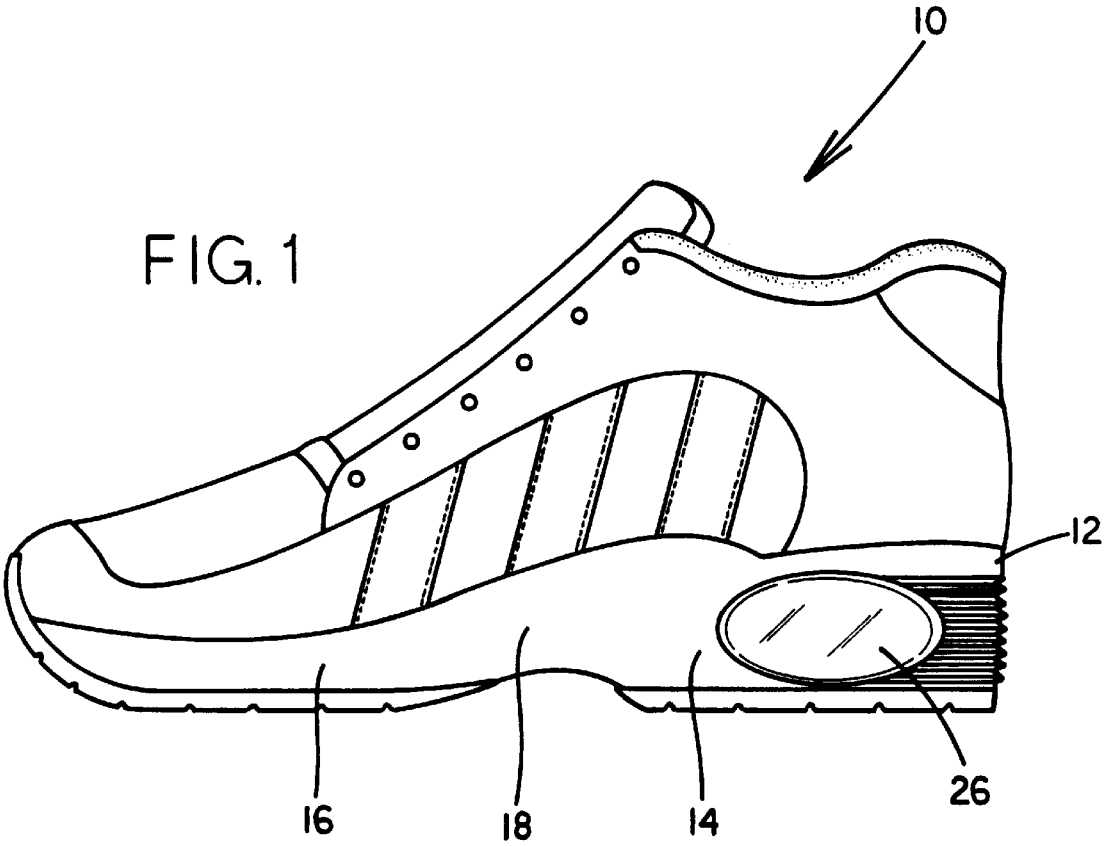
FIG. 1 is a side view of a new vented shoe sole according to the present invention.

With reference now to the drawings, and in particular to FIGS. 1 through 4 thereof, a new vented shoe sole embodying the principles and concepts of the present invention and generally designated by the reference numeral 10 will be described.

Figure 2:
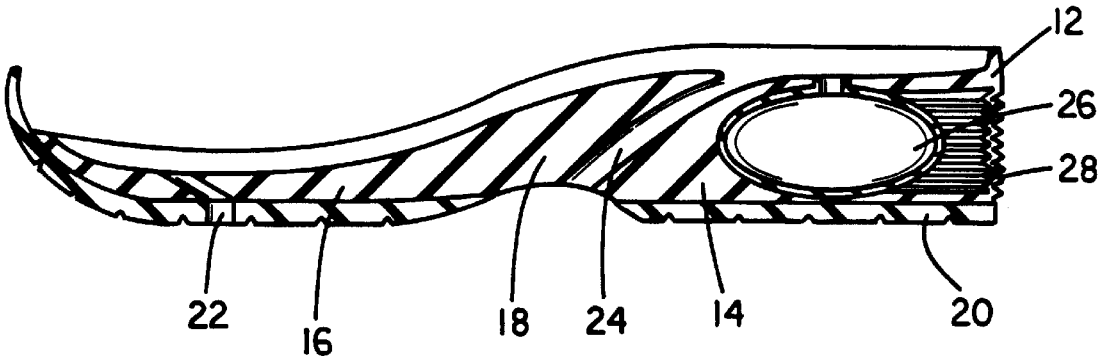
FIG. 2 is a side cross-sectional view of the present invention.

The present invention, designated as numeral 10, includes a sole 12 formed of an elastomeric niaterial. The sole has a heel portion 14 with a first thickness and a toe portion 16 with a second thickness less than ⅓ the first thickness. Formed between the toe and heel portion is an interimediate portion 18 which is defined by a tapering top face. As shown in FIG. 2, a bottom surface of each portion of the sole remains within a common plane and has a gripping material 20 mounted thereon. To define a shoe, the sole has a low top leather upper coupled thereto for containing a foot of a user.

Next provided is a pair of vents including a toe vent 22 having an oval cross-section along a length thereof. The toe vent includes a bottom end laterally disposed at a central extent of the bottom surface of the toe portion of the sole. It should be noted that the bottom end extends through a recess formed in the gripping material associated with the toe portion. A top end of the toe vent terminates in three laterally aligned apertures formed in an upper surface of the toe portion of the sole. The toe vent further has an intermediate extent extending upwardly and forwardly from the bottom surface of the toe portion of the sole, as shown in FIG. 2.

The pair of vents further include a heel vent 24 having an oval cross-section along a length thereof. The heel vent includes a bottom end laterally disposed at a central extent of the bottom surface of the intermediate portion of the sole. It should be noted that the bottom end extends through a recess formed in the gripping material associated with the intermediate portion of the sole. See FIG. 3. A top end of the heel vent terminates in three longitudinally aligned apertures formed in an upper surface of the heel portion of the sole. The apertures of the top end of both the toe and heel vents may be afforded by a cover situated over the vent with the apertures formed therein. As shown in FIG. 2, an intermediate extent of the heel vent extends upwardly and rearwardly in a torsional manner from the bottom surface of the intermediate portion of the sole.

Finally, an air flow chamber 26 is provided having an oval cross-section formed along a length thereof. The air flow chamber is situated about a horizontal axis which is laterally disposed within the heel portion of the sole to the rear of the heel vent. The air flow chamber has a pair of ends with transparent membranes mounted thereon which are visible from sides of the sole. The air flow chamber further includes an aperture formed in a top face thereof which remains in communication with the apertures of the top end of the heel vent. As an option, a one-way valve is mounted within the aperture. As shown in FIGS. 1 & 2, the air flow chamber further includes a Plurality of bellows 28 situated between a rear of the air flow chamber and a rear of the sole. As shown in FIG. 1, the bellows encompass an entire rear periphery of the sole and further abut the membranes associated with the air chamber. Such bellows function for directing a flow of air through the aperture of the air flow chamber when the user walks. As an option, the bellows may be, equipped with intake apertures.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A air cushioned shoe comprising, in combination:

a sole formed of an elastomeric material and having a heel portion with a first thickness, a toe portion with a second thickness less than ⅓ the first thickness, and an intermediate portion formed therebetween which is defined by a tapering top face, wherein a bottom surface of each portion of the sole remains within a common plane and has a gripping material mounted thereon;

a low top leather upper coupled to the sole for containing a foot of a user;

a pair of vents including a toe vent having an oval cross-section along a length thereof and including a bottom end laterally disposed at a central extent of the bottom surface of the toe portion of the sole, a top end terminating in three laterally aligned apertures formed in an upper surface of the toe portion of the sole, and an intermediate extent extending upwardly and forwardly from the bottom surface of the toe portion of the sole, the pair of vents further including a heel vent having an oval cross-section along a length thereof and including a bottom end laterally disposed at a central extent of the bottom surface of the interimediate portion of the sole, a top end terminating in three longitudinally aligned apertures formed in an upper surface of the heel portion of the sole, and an intermediate extent extending upwardly and rearwardly from the bottom surface of the intermediate portion of the sole; and an air flow chamber having an oval cross-section formed along a length thereof, the air flow chamber being situated about a horizontal axis which is laterally disposed within the heel portion of the sole, the air flow chamber having a pair of ends with transparent membranes mounted thereon which are visible from sides of the sole, the air flow chamber further including an aperture formed in a top face thereof which remains in communication with the top end of the heel vent, the air flow chamber further including a plurality of bellows situated between a rear of the air flow chamber and a rear of the sole for directing a flow of air through the aperture of the air flow chamber when the user walks.

2. An air cushioned shoe comprising:

a sole having a heel portion, a toe portion, and an intermediate portion formed therebetween which is defined by a tapering top face, wherein a bottom surface of each portion of the sole remains within a common plane and has a gripping material mounted thereon;

an upper coupled to the sole for containing a foot of a user;

a pair of vents including a toe vent and including a bottom end laterally disposed at a central extent of the bottom surface of the toe portion of the sole, a top end terminating in a plurality apertures formed in an upper surface of the toe portion of the sole, and an intermediate extent extending upwardly and forwardly from the bottom surface of the toe portion of the sole;

the pair of vents further including a heel vent including a bottom end laterally disposed at a central extent of the bottom surface of the intermediate portion of the sole, a top end terminating in a plurality of apertures formed in an upper surface of the heel portion of the sole, and an intermediate extent extending upwardly and rearwardly from the bottom surface of the intermediate portion of the sole; and an air flow chamber being disposed in the heel portion of the sole, the air flow chamber having a pair of ends with transparent membranes mounted thereon which are visible from sides of the sole, the air flow chamber further including an aperture formed in a top face thereof which remains in communication with the top end of the heel vent, the air flow chamber further including a plurality of bellows situated between a rear of the air flow chamber and a rear of the sole for directing a flow of air through the aperture of the air flow chamber when the user walks.

3. The air cushioned shoe of claim 2, wherein the sole is formed of an elastomeric material.

4. The air cushioned shoe of claim 3, wherein the heel portion of the sole has a first thickness and the toe portion of the shoe has a second thickness less than ⅓ the first thickness.

5. The air cushioned shoe of claim 4, wherein the vents each have an oval cross-section along a length thereof.

6. The air cushioned shoe of claim 5, wherein the plurality of apertures of the toe vent are laterally aligned with each other, and wherein the plurality of apertures of the heel vent are laterally with each other.

7. The air cushioned shoe of claim 6, wherein the air flow chamber has an oval cross-section formed along a length thereof.

8. The air cushioned shoe of claim 7, wherein the air flow chamber is situated about a horizontal axis which is laterally disposed within the heel portion of the sole.

* * * * *